United States Patent [19]

Feagans et al.

[11] Patent Number: 4,500,756

[45] Date of Patent: Feb. 19, 1985

[54] KEYBOARD SWITCH HAVING A DEFORMABLE MEMBRANE FORMED OF CELLULAR URETHANE

[75] Inventors: Frederick C. Feagans, Central, S.C.; Albert W. Nordquist, Ivoryton, Conn.

[73] Assignee: Pratt-Read Corporation, Ivoryton, Conn.

[21] Appl. No.: 359,827

[22] Filed: Mar. 19, 1982

[51] Int. Cl.[3] ..... H01H 9/00

[52] U.S. Cl. ..... 200/5 A; 84/1.14; 84/DIG. 7; 200/159 B

[58] Field of Search ..... 200/5 R, 5 A; 84/1.14, 84/1.24, DIG. 7, 433, 159 B

[56] References Cited

U.S. PATENT DOCUMENTS

| | | | |
|---|---|---|---|
| 3,447,414 | 6/1969 | Lo Duca | 84/436 |
| 3,657,460 | 4/1972 | Cutler | 84/DIG. 7 |
| 3,699,294 | 10/1972 | Sudduth | 200/159 B X |
| 3,728,509 | 4/1973 | Shimojo | 200/159 B |
| 3,745,874 | 7/1973 | Martin et al. | 84/433 |
| 3,750,522 | 8/1973 | Groves et al. | 84/423 |
| 3,774,493 | 11/1973 | Yamada | 84/423 |
| 3,855,894 | 12/1974 | Thomas et al. | 84/423 |
| 3,862,879 | 1/1975 | Barron et al. | 161/159 |
| 3,911,233 | 10/1975 | Nakamura et al. | 200/5 R |
| 3,911,780 | 10/1975 | Dyle et al. | 84/423 |
| 3,932,722 | 1/1976 | Obata et al. | 200/340 |
| 3,965,789 | 6/1976 | Pearlman | 84/1.24 |
| 4,079,651 | 3/1978 | Matsui | 84/1.1 |
| 4,111,091 | 9/1978 | Hinago | 200/159 B X |
| 4,117,279 | 9/1978 | Schoemer | 200/5 A |
| 4,186,638 | 2/1980 | Iijima | 84/1.01 |
| 4,205,583 | 6/1980 | Absmann | 84/433 |
| 4,258,096 | 3/1981 | LaMarche | 428/209 |
| 4,272,657 | 6/1981 | Iijima | 200/5 A |

OTHER PUBLICATIONS

Poron, Rogers Corporation, 12/78, Brochure of 4 sheets.

*Primary Examiner*—A. D. Pellinen
*Assistant Examiner*—Morris Ginsburg
*Attorney, Agent, or Firm*—Ratner & Prestia

[57] ABSTRACT

A keyboard for a musical instrument having a plurality of elongated keys with each key having a rearwardly extending actuating arm. The arm has an upper and a lower nonresilient switch actuator for actuating a respective first and second keyboard switch with each switch having a substrate with at least one fixed contact. A deformable membrane has coupled thereto a movable contact which is adapted for movement into and out of electrical connection with the fixed contact. The first and second switches are positioned so that the lower actuator normally maintains closed the first switch and when the key is actuated the first switch opens and the upper actuator closes the second switch. The deformable membrane is formed of Poron cellular urethane which distributes and absorbs the actuation force and springs back to its undeformed shape when not actuated.

14 Claims, 7 Drawing Figures

KEYBOARD SWITCH HAVING A DEFORMABLE MEMBRANE FORMED OF CELLULAR URETHANE

BACKGROUND OF THE INVENTION

A. Field of the Invention

This invention relates generally to a keyboard device for a musical instrument, and specifically to a keyboard switching device for an electronic musical instrument.

B. Background Art

A keyboard type electronic musical instrument is generally constructed to open or close a tone signal source by key depressing pressure. Moreover, a touch-responsive effect is generally added to control the amplitude of the tone signal in response to key depressing speed. Such touch-responsive control depends on measuring the time difference between the start and end of key depression. This time measurement may be done in several ways. For example, in may be done by way of two switches—one normally closed (NC) and the other normally open (NO)—which are connected to a charging/discharging circuit. Immediately upon key depression the NC switch is opened, causing a charged capacitor in the circuit to begin discharging. At the end of key travel the NO switch is closed, causing the remaining voltage on the capacitor to be sampled. The faster the key depression, the larger the remaining voltage on the capacitor and the louder the corresponding note will sound. Thus, there is frequently a need for NC and NO switches in an electronic musical instrument.

In prior art electronic musical instruments, switches have been formed of a stationary contact piece arranged on a base plate, and a movable contact piece arranged above the stationary piece. The movable piece has been formed of a resilient material, such as rubber, and a conductive portion, such as conductive rubber, carbon, silver, etc. adhered thereto. In the normally open state, the conductive portion was maintained at the upper position by the tension inherent in the resilient material with the result that it was separated in space from the stationary piece. Over extended usage, the resilience of the material would decrease or tend to set causing the conductive portion to come in contact with the stationary piece. Once setting occurred, the NO switch had to be replaced. This, of course, increased the cost of repair and maintenance of the instrument.

Due to the setting tendency of the material, it has not been feasible to construct a NC flexible switch. NC flexible switches made in the standard way would tend to set rather quickly, since with a key in its normal rest position the NC switch would be compressed closed most of the time. As a result of the constant pressure, upon depression of the key, the NC switch tended to remain closed.

Thus, it has not been possible to construct a NC switch from flexible or resilient material. It has also not been possible to construct a NO switch from flexible or resilient material which has long endurance characteristics and does not set after prolonged use.

SUMMARY OF THE INVENTION

A keyboard switch having a nonresilient actuator with a substrate having at least one fixed contact thereon. A deformable membrane has coupled thereto a movable contact positioned adjacent the fixed contact and is adapted for movement into and out of electrical connection with the fixed contact for completing a circuit. There is provided means for actuating the nonresilient actuator to engage, push against and deform the deformable membrane to thereby move the movable contact. The deformable membrane is formed of Poron cellular urethane. Accordingly, upon actuation of the actuator the deformable membrane distributes and absorbs the actuation force without damage to the keyboard switch while the movable contact engages the fixed contact. Upon release of the actuator the deformable membrane springs back without taking a compression set to its undeformed shape retracting the movable contact from the fixed contact.

DESCRIPTION OF THE PREFERRED EMBODIMENTS

Figure 1:
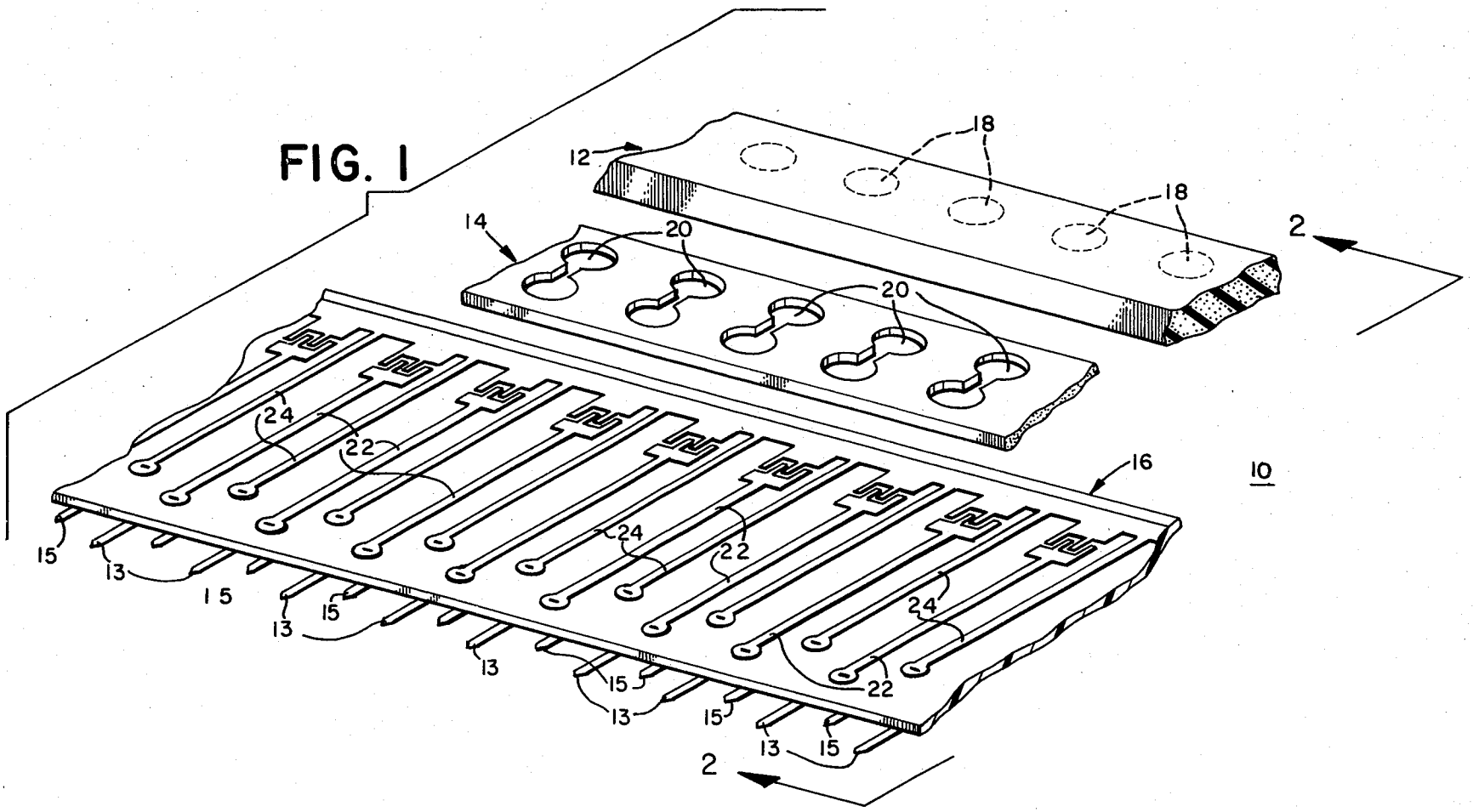
FIG. 1 is a perspective view showing a switch assembly of the present invention.
Figure 2:
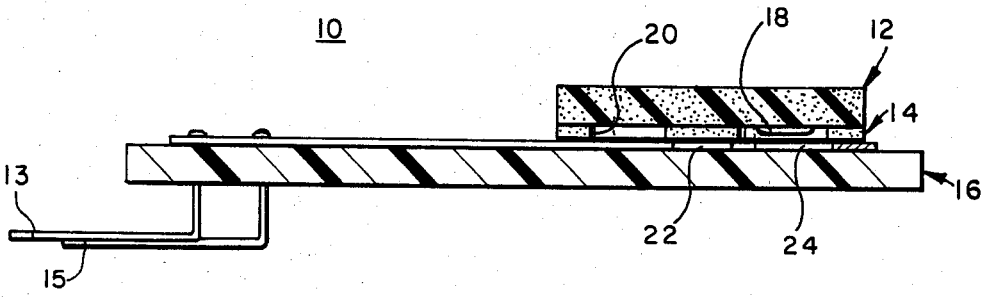
FIG. 2 is a sectional view along lines 2—2 of the switch assembly of FIG. 1.

Referring to FIGS. 1 and 2, there is shown one example of a switching assembly 10 for an electronic musical instrument. In the preferred embodiment, assembly 10 is formed of a printed circuit board 16, a spacer 14, a strip of resilient material 12, and a pattern of contact elements 18 deposited on the lower portion of strip 12. As will be described in detail later, switching assembly 10 is arranged in such a manner as to form a set of contact switches, whereby upon depression of a section of strip 12, a related movable contact element 18 is forced into contact with a corresponding pair of fixed elements 22,24.

In the preferred embodiment, the strip of resilient material 12 is comprised of cellular urethane, known as "Poron" ® whose properties will be described in detail later. Due to the unique characteristics of Poron it has been found that its properties are particularly well adapted for the construction of normally closed (NC), as well as normally open (NO) switches utilized in electronic musical instruments.

Printed circuit board 16 consists of an epoxy-glass substrate having circuit elements 22, 24 printed thereon. Elements 22,24 are electrically connected through board 16 to leads 13, 15 respectively. The circuit elements may be formed on the substrate by well known techniques. For example, an electrodeposited copper surface may be etched using photoresist material to provide the conductive element configuration. The copper traces thus formed are then plated with a tin/-lead alloy to provide the desired fixed contact elements.

The movable contact elements 18 are deposited on the lower portion of resilient strip 12 by conventional means. Contact elements 18 are formed of electrically conducting material such as flexible silver ink which may be screen printed directly on the poron strip. Each movable contact 18 is disposed immediately above and in alignment with a pair of corresponding fixed contact elements 22,24. In this manner, upon depression of a section of Poron strip 12, movable element 18 is made to contact a pair of fixed elements 22, 24, thus forming an electrically closed circuit.

Maintaining a spacing between each pair of fixed elements 22, 24 and each movable element 18 is spacer 14. The spacer, which is formed of insulated material, is constructed with holes 20 slightly larger than fixed elements 22, 24, so that movable elements 18 may be brought in contact with the fixed elements. Spacer 14 is attached by conventional adhesive means to printed circuit board 16 and Poron strip 12.

Figure 3:
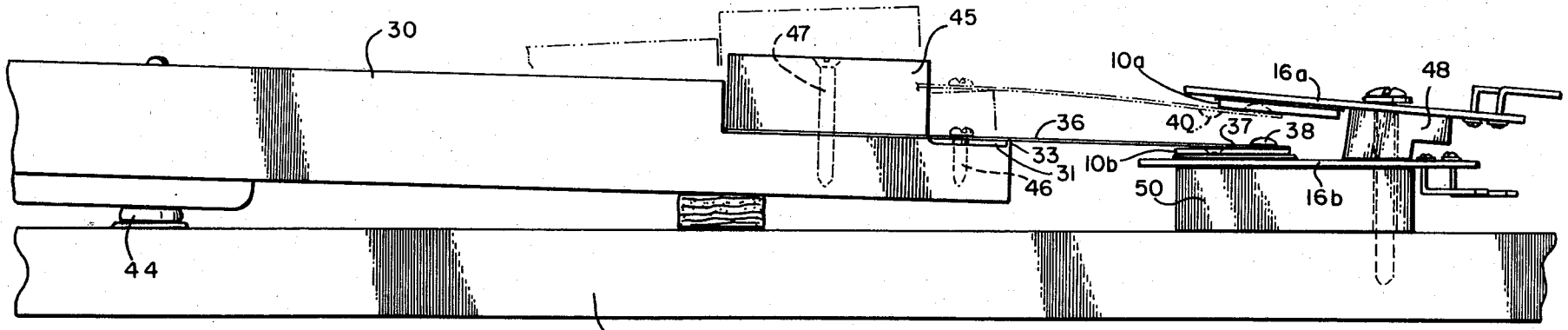
FIG. 3 is a sectional view of a keyboard actuator key with a normally-open and a normally-closed switch assembly of FIG. 1.

As already mentioned, switching assembly 10 may be used in either a NC or NO switch configuration. Usage of both switch configurations is depicted by way of example in FIGS. 3–5. Referring to FIG. 3, there is shown one of the keys 30 of a keyboard for a musical instrument. Key 30, it will be understood, can be mounted in a variety of ways in a key-bed or key-frame chassis 42. It will be understood that key 30 is mounted to pivot about a direction generally perpendicular to its longitudinal dimension on a fulcrum element, such as fulcrum member 44 shown figuratively in FIG. 3. The forward portion of key 30 is accessible to a user's hand upon the playing of the keyboard; the rear portion of key 30 is aligned longitudinally with a single pair of switches—normally closed switch assembly **10*b* and normally open switch assembly 10*a***.

The rear portion of key 30 falls short of switch assemblies **10*a* and 10*b*. Extending toward the pair of switches is resilient lever arm 36 which is attached to the rear portion of key 30. Specifically lever arm or actuator 36 is a flat spring steel which has sufficient resiliency to actuate switching assemblies 10*a,b* in the illustrated dotted line and full line positions respectively. Actuator 36 is rigidly secured in position by a conventional lead block 45 held by a fastening screw 47. Actuator 36 extends rearwardly from block 45 over open area 31, engages the upper surface of pivot portion 33 and terminates in a rear actuator section 37. Rear section carries actuating tits 38 and 40. A screw 46 projects through actuator 36 and open area 31 into key 30 for adjusting the actuator spring up or down with respect to shoulder 33. It will be understood that the weight of lead block 45 aids in maintaining closed switch assembly 10*b***.

A first tit 40, directed toward NC switch assembly **10*b*, and a second tit 38, directed toward NO switch assembly 10*a*, are formed integrally with rear section 37 of lever arm or actuator 36. The tits provide the medium through which Poron strips 12*a*, 12*b* may be depressed and thereby electrically actuate the switches. When key 30 is in its normally rest position (full line position, FIG. 3), lever arm 36 positions tit 40 immediately above, but in contact with switch assembly 10*b*. The contact pressure provided by tit 40 is sufficient to depress Poron strip 12*b* so that switch 10*b*** is in a normally closed position.

With key 30 in its normally rest position, switch assembly **10*a* is maintained in a normally open state. Upon actuation of key 30 by the player, tit 38 is rotated upwardly by lever arm 36 and is effective to depress Poron strip 12*a*. In this manner, switch assembly 10*a* is actuated to its closed state. Upon release of key 30, lever arm 36 returns to its lower position, thereby actuating switch 10*b* and deactuating switch 10*a***.

As shown in FIG. 3, switch assembly **10*b* is supported horizontally by spacer 50 and separated from assembly 10*a* by spacer 48. Further, spacer 48 is effective to tilt the side of assembly 10*b* adjacent key 30 upwardly from the horizontal so that tit 40 is effective to actuate switch 10*b* while key 30 is in its rest position, and tit 38 is effective to actuate switch 10*a* upon rotation of key 30. The vertical separation distance between assemblies 10*a, b* and the vertical separation distance between assembly 10*b* and chassis 42 may be easily determined by knowledge of the height of lever arm 36 during its rest position and the height after key 30 depression. Similarly, the horizontal separation distance between the rear of key 30 and both switching assemblies 10*a, b* may be easily determined by knowledge of the length of lever arm 36 and the length between tits 38 and 40**.

Figure 4:
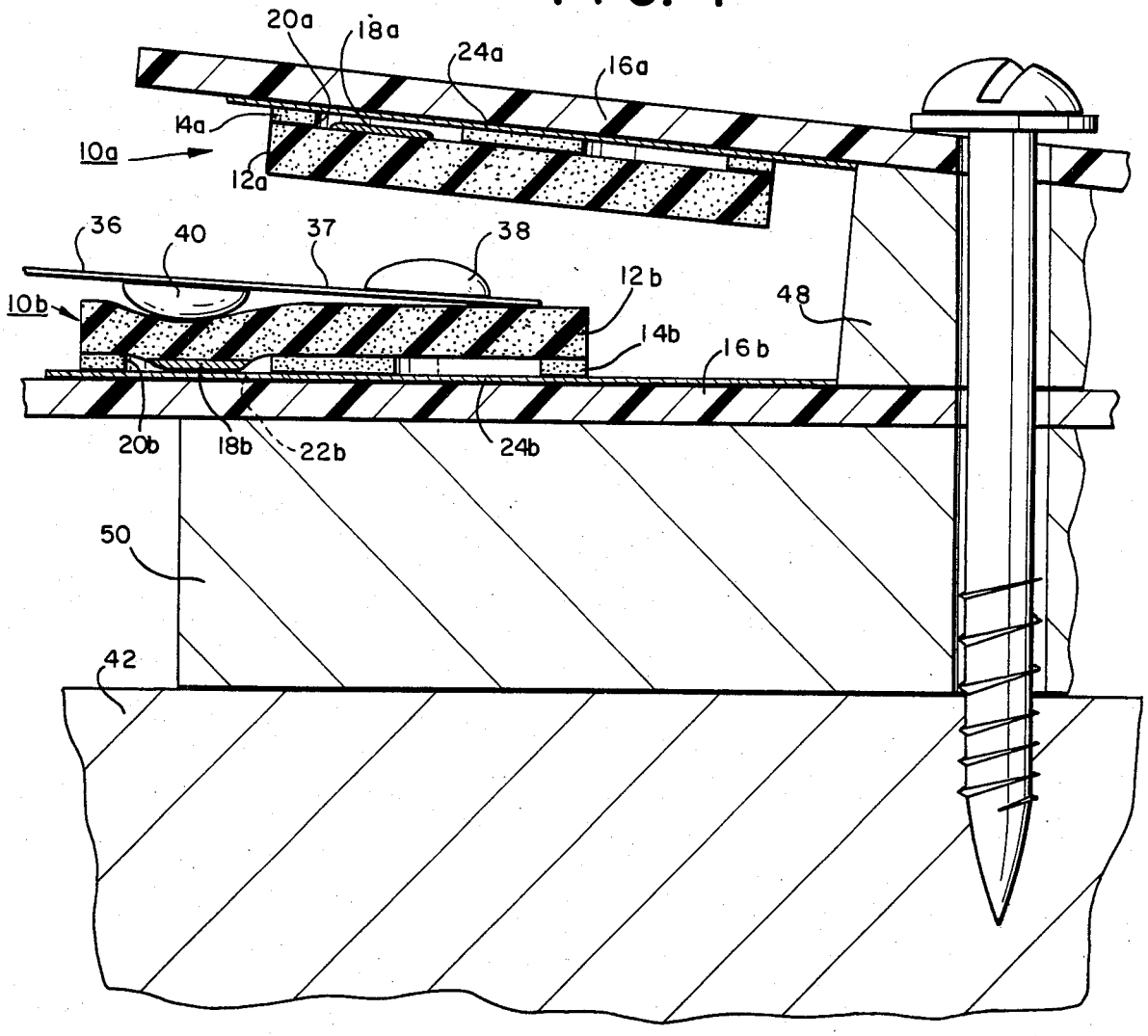
FIG. 4 is an enlarged sectional view of the actuator key in rest position and the switch assemblies of FIG. 3.
Figure 5:
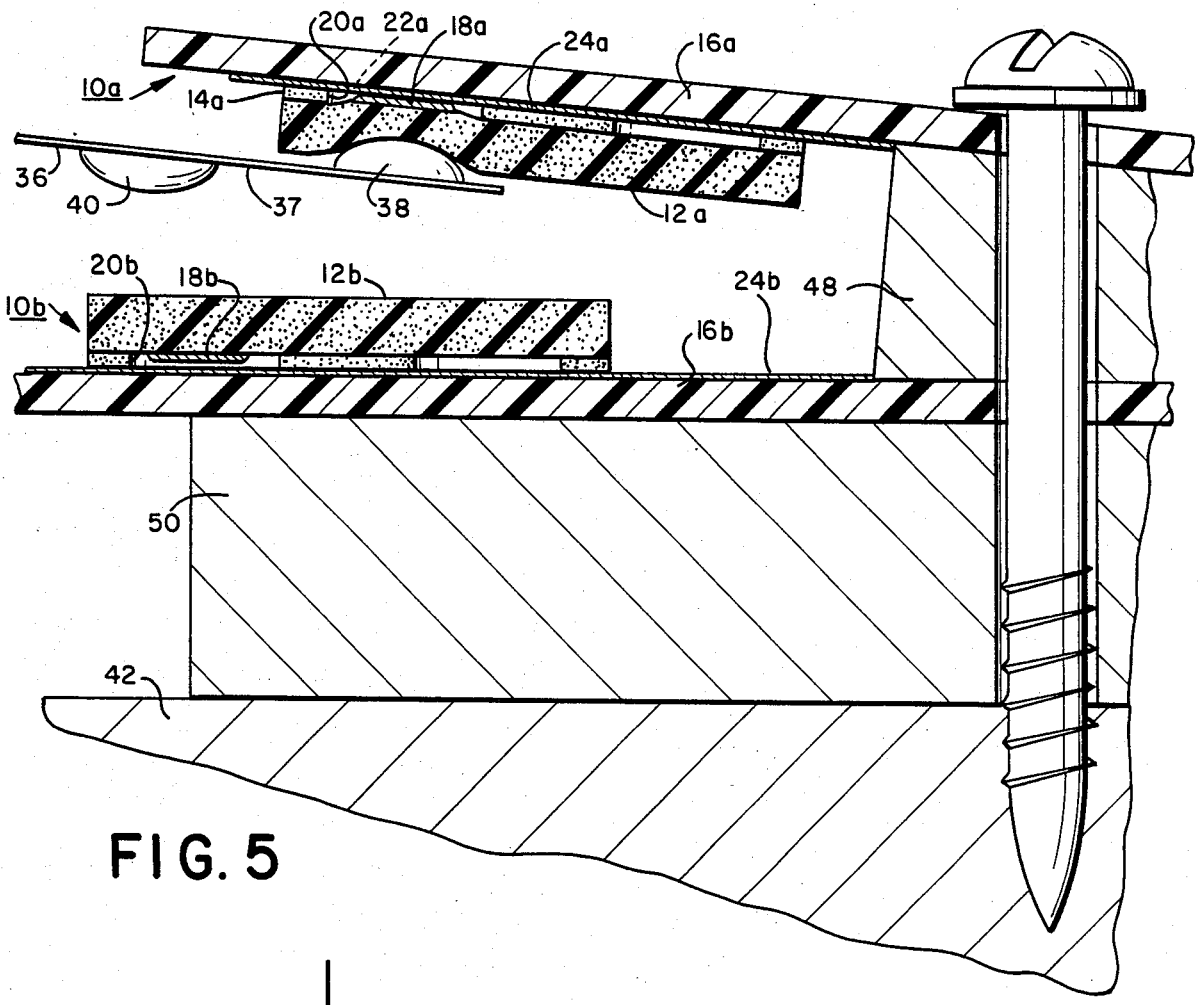
FIG. 5 is an enlarged sectional view of the actuator key in actuated position and the switch assemblies of FIG. 3.

Referring now to FIGS. 4 and 5, the operation of switch assemblies **10*a*, 10*b* may be better understood. In FIG. 4, lever arm 36 is shown in its rest position. It is at this position that switch 10*b* is actuated by way of pressure from tit 40. During this state poron strip 12*b* is deformed downwardly through hole 20*b* of insulated spacer 14*b*, thereby causing movable contact element 18*b* to electrically connect with fixed contact elements 22*b*, 24*b* on printed circuit board 16*b*. It will be understood that there may be individual leads or an edge connector to couple the electrical signals to and from contact elements 22*b*, 24*b*. Upon actuation of key 30 by the player, lever arm 36 is pivoted toward switch assembly 10*a* and away from switch assembly 10*b*, as shown in FIG. 5, thereby permitting Poron strip 12*b* to spring back to its original undeformed shape. As a result, movable contact element 18*b* is retracted from fixed contact elements 22*b*, 24*b*. As will be described later, it is the unique properties of Poron that permits switch 10*b* to be configured in a normally closed state over a long duration and yet maintain the resilience necessary to retract the movable contact elements from the fixed contact elements upon actuation of key 30**.

Referring again to FIG. 4, switch assembly **10*a* is shown in its normally open state while lever arm 36 is in its rest position. Upon actuation of key 30, lever arm 36 is rotated upwardly thereby causing tit 38 to upwardly deform Poron strip 12*a* through hole 20*a* of insulated spacer 14*a*, as shown in FIG. 5. As a result, movable contact element 18*a* is electrically connected to fixed elements 22*a*, 24*a* on printed circuit board 16*a*. Upon release of key 30, Poron strip 12*a* springs back to its original undeformed shape, retracting movable contact element 18*a* from fixed elements 22*a*, 24*a*. In this manner, switch 10*a*** returns to its normally open state.

As mentioned earlier, it is the unique properties of Poron that permits the usage of flexible switches in either a normally closed or normally open state. Whereas prior art flexible switches relying on polyester film or rubber tend to take a set after prolonged usage, the flexible switches of the present invention relying on Poron do not have similar shortcomings. In prior art switches, the setting appears to result from the polyester films or rubber distorting from prolonged pressures. Consequently, when the switching forces are removed (in the case of NC switches), the polyester films or rubber tend to remain closed. The Poron material, on the other hand, has long term memory characteristics of its undeformed shape which may be subjected to continuous and prolonged compressive pressures from a nonresilient actuator without distortion. The following table shows the long term compression of Poron for samples tested at room temperature and 50% relative humidity:

| TIME | COMPRESSIVE SET (% of original thickness) |
|---|---|
| 12 weeks | <1.0% |
| 26 weeks | 1.0-2.6% |
| 39 weeks | 2.0-3.6% |
| 52 weeks | 1.0-2.7% |

All samples were subjected to 50% compression tests. It was found that Poron has one of the lowest, if not the lowest, compression sets of any elastomeric cellular product available. Since Poron will simply not collapse or bottom out, it may be used as a reliable component in the making of NC or NO switches.

The Poron material also tends to distribute and absorb the actuation force more evenly, allowing enough force at the center of switch spacer holes 20 to force the movable element in contact with the fixed elements. However, at the perimeter sides of the spacer holes there exists minimal force. Since there is little force at the perimeter sides, the adhesive between spacer 14 and Poron strip 12 is not disturbed.

Figure 6:
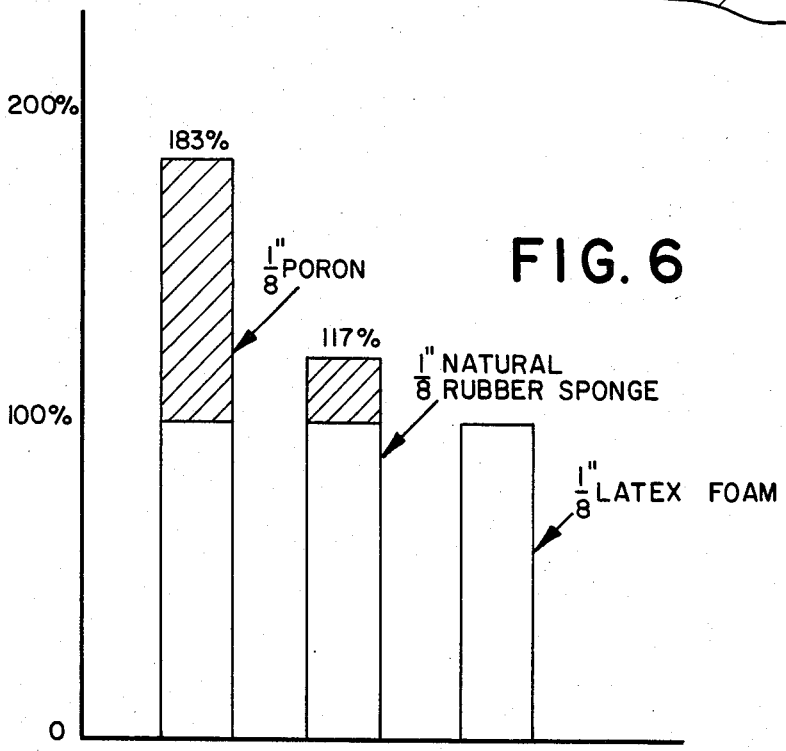
FIG. 6 is a bar chart comparing Poron, natural rubber sponge and latex foam.

The switch of the present invention with the Poron material also requires less actuation force than a conventional polyester film switch. The actuation force required by the Poron switch is less than $\frac{1}{3}$ that required by a polyester film switch. Although less actuation force is required, the Poron switch has capability of absorbing the remaining force imparted by a player's hand without damaging the switch. It will be understood that force absorption is very important in a musical instrument keyboard. In a normally open switch, only the first 33% (approximately) of the total key travel is actually required to accomplish switch closure. The remaining approximately 66% must be absorbed without damaging the switch and simultaneously providing no appreciable change in feel to the musician's hand. The Poron switch of the present invention has been found to satisfy this force absorption requirement very well. The bar chart of FIG. 6 shows the relative amount of force absorption of Poron as compared to rubber and latex foam. As can be seen Poron can absorb 83% more energy than latex foam and 66% more than rubber.

It has also been found that the Poron switch not only has a longer life-cycle than a conventional switch due to its excellent force absorption characteristics and its long term memory characteristics, but it also is more forgiving to manufacturing variables. With an increased air gap and flexible properties, the Poron may be easily and cheaply manufactured. Poron is produced from cellular urethane by continuously casting a reactive urethane mixture to the desired thickness. Since Poron is mechanically frothed causing open cells, thickness and density may be controlled to an uncommon accuracy, unlike many chemically blown foams. Poron is a trademark of and is manufactured by Rogers Corporation, E. Woodstock, Conn. 06244.

Figure 7:
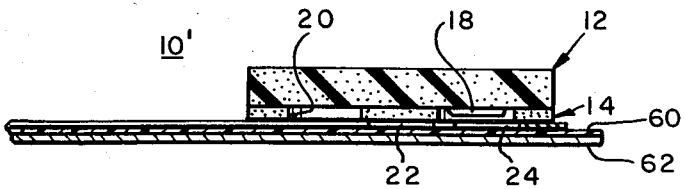
FIG. 7 is another embodiment of the invention in which the switch assembly of FIG. 1 is mounted on a metal chassis covered by Mylar.

Now that the principles of the invention have been explained, it will be understood that many modifications may be made. For example, as shown in FIG. 7, instead of circuit board 16, switch 10' may be mounted on a metal chassis 62 covered by membrane 60 of Mylar film. Fixed elements 22, 24 of copper etch circuits may be disposed on membrane 60 with spacer 14 adhesively attached between the membrane and Poron strip 12. As previously described, a movable contact element 18 may be brought in contact with fixed elements 22, 24 through one of the openings 20.

It will be understood that opening 20 comprises a pair of circular holes only one of which has been used by movable contact element 18 in the above described embodiments. In a still further embodiment, a pair of movable contact elements 18 may be provided each associated with a corresponding one of the pair of circular holes. A pair of fixed contact elements may be associated with each of the movable contact elements so that a switch assembly such as assembly 10' comprises two separate switches (double pole). Such an assembly may be activated by a pair of adjustable screws downwardly extending from a key as shown in FIG. 9B of patent application Ser. No. 06/162,914 filed 6/25/80 by K. T. Tollefsen and A. W. Nordquist for Keyboard for Musical Instrument, now Pat. No. 4,418,605 issued 12/6/83, and assigned to the same assignee as this application. The two adjusting screws may be used to actuate the above described pair of switches at different time intervals during key travel. As known in the art, such assembly may be used for time measurement of key travel. With the pair of switches being normally open, the first switch closes at the top of key travel and the second switch closes at the bottom of key travel.

What is claimed is:

1. A keyboard switch having a nonresilient actuator comprising a substrate having at least one fixed contact thereon, a deformable membrane having disposed directly thereon a movable electrically conductive coating, said coating positioned adjacent said fixed contact and adapted for movement into and out of electrical connection with said fixed contact for completing a circuit therebetween, means for actuating said nonresilient actuator to engage and push against said deformable membrane and thereby to move said movable coating, and said deformable membrane being formed of mechanically frothed open cell cellular urethane foam whereby (1) upon actuation of the actuator said deformable membrane distributes and absorbs the actuation force without damage to the keyboard switch while the movable coating engages the fixed contact and (2) upon release of the actuator the deformable membrane springs back without taking a compression set to its undeformed shape retracting the movable coating from the fixed contact.

2. The keyboard switch of claim 1 in which said actuating means includes a key for moving said actuator with the first approximately 33% of key travel providing contact between said movable coating and fixed contact and the remaining approximate 66% of key travel being absorbed by said deformable membrane.

3. The keyboard switch of claim 2 in which said nonresilient actuator comprises a hard rounded actuator which engages the side of said deformable membrane remote from said movable coating.

4. The keyboard switch of claim 1 in which said actuating means includes means for normally maintaining the actuator engaging the deformable membrane to maintain said switch normally closed whereby said deformable membrane maintains its long term memory characteristics of its undeformed shape.

5. The keyboard switch of claim 1 in which said movable coating is formed on the lower surface of said deformable membrane.

6. The keyboard switch of claim 5 in which there is provided a spacer between the deformable membrane and said substrate with an opening provided for movement of said movable coating.

7. The keyboard switch of claim 1 in which said movable coating comprises a flexible metallic ink screen printed directly upon said deformable membrane itself.

8. A keyboard for a musical instrument having a plurality of elongated key assemblies with each key assembly comprising a plurality of elongated keys each having a rearwardly extending actuating means with an upper and a lower nonresilient actuator, a first and a second switch, each having a substrate with at least one fixed contact thereon, a deformable membrane having a movable electrically conductive coating disposed directly thereon, said coating positioned adjacent said fixed contact and adapted for moving into and out of electrical connection with said fixed contact for completing a circuit therebetween, means for mounting said first switch to be engaged by the lower actuator when the key is in its lower position and means for mounting said second switch to be engaged by the upper actuator when the key is in its upper position, the key being maintained normally engaging the deformable membrane of said first switch to maintain said first switch normally closed, and said deformable membrane being formed of mechanically frothed open cell cellular urethane foam whereby upon actuation the deformable membrane distributes and absorbs the actuation force without damage to the keyboard switches and upon release the deformable membrane springs back to its undeformed shape retracting the movable coating from the fixed contact.

9. The keyboard of claim 8 in which each of said first and second switches are formed to provide contact between said movable coating and fixed contact during the first approximate 33% of key travel and the remaining approximate 66% of key travel being absorbed by said deformable membrane.

10. The keyboard of claim 9 in which each of said nonresilient actuators comprise a hard rounded actuator which engages the side of respective deformable membrane remote from said movable coating.

11. The keyboard of claim 9 in which each first and second switch is disposed on a printed circuit board with said fixed contact being formed of a printed circuit element on said board and in which there is provided a spacer between the deformable membrane and said board.

12. The keyboard of claim 9 in which each first and second switch is disposed on a polyester film covering a chassis with said fixed contact being formed on the film and in which there is provided a spacer between the deformable membrane and the film with an opening provided for said movable coating.

13. The keyboard of claim 8 in which each first and second switch has a respective movable coating formed on the lower surface of said deformable membrane.

14. The keyboard of claim 8 in which said movable coating comprises a flexible metallic ink screen printed directly upon said deformable membrane itself.

* * * * *